US005174208A

United States Patent [19]

Fink et al.

[11] Patent Number: 5,174,208

[45] Date of Patent: Dec. 29, 1992

[54] INK MARKER

[75] Inventors: Cameron L. Fink; Robert W. Schram; Anthony J. Gentile, all of London, Canada

[73] Assignee: Sterling Marking Products Inc., Ontario, Canada

[21] Appl. No.: 679,404

[22] Filed: Apr. 2, 1991

[30] Foreign Application Priority Data

Apr. 4, 1990 [CA] Canada ..... 2013548

[51] Int. Cl.[5] ..... B41K 1/40

[52] U.S. Cl. ..... 101/333; 101/103

[58] Field of Search ..... 101/103, 109, 104, 327, 101/333, 334, 379, 368

[56] References Cited

U.S. PATENT DOCUMENTS

| | | | |
|---|---|---|---|
| 2,920,559 | 1/1960 | Becker | 101/327 |
| 2,939,385 | 6/1960 | Wolberg | 101/31.1 |
| 3,756,153 | 9/1973 | Cohen | 101/368 |
| 3,853,411 | 12/1974 | Ciraolo | 101/368 |
| 4,291,622 | 9/1981 | Bengtsson | 101/109 |
| 4,530,281 | 7/1985 | Verdenne | 101/104 |
| 4,579,057 | 4/1986 | Hewitt et al. | 101/379 |
| 4,805,529 | 2/1989 | Becher | 101/333 |
| 4,881,841 | 11/1989 | Irwin | 101/379 |

FOREIGN PATENT DOCUMENTS

| | | | |
|---|---|---|---|
| 108187 | 6/1983 | Japan | 101/109 |
| 67079 | 4/1984 | Japan | 101/31.1 |
| 162684 | 8/1985 | Japan | 101/327 |
| 164577 | 7/1987 | Japan | 101/368 |
| 115777 | 5/1988 | Japan | 101/368 |

*Primary Examiner*—Edgar S. Burr
*Assistant Examiner*—Ren Yan
*Attorney, Agent, or Firm*—Rogers & Scott

[57] ABSTRACT

A self inking stamp is provided for use in making an image on paper. The stamp comprises a body having a base including portions lying in a plane for engagement with a flat piece of paper, and a marker having a self inking indicia. The maker is movable relative to the base generally at right angles to the aforementioned plane, and a coupling is provided attaching the marker to the base at a location spaced from the marker generally parallel to the plane. The coupling permits movement of the marker to a stored position inside the body and spaced from the plane, and an inking position with the marker in engagement with the paper.

5 Claims, 3 Drawing Sheets

INK MARKER

BACKGROUND OF THE INVENTION

This invention relates to self inking stamps of the kind used manually to impress an ink image of indicia on paper or other similar material.

Stamps have been used for many years to place the message, design or other indicia on paper repeatedly. For instance, such indications such as "copy", "confirmation" are commonly used in offices and placed on outgoing mail or mail in files. The indicia is usually enlarged and can be coloured for ready recognition on the paper.

Originally, stamps were made to pick up ink from a pad supplied for the purpose. The indicia consisted of lettering or design which was raised from a support so that the raised design would touch the ink, carry it to the paper, and pass the ink onto the paper when the stamp was pressed on the paper. The ink pad was a necessary part of the stamp and the two went together.

More recently, so called "self inking" stamps have become well known. These consist of a porous material used to make the indicia and carried on a support which itself carries ink. When the stamp is pressed on the paper, the action releases some ink through the indicia onto the paper. This can be repeated many times until the ink is exhausted. The ink supply can be replaced in some instances. These devices have gained a great deal of acceptance but do suffer from disadvantages. First of all, the porous indicia with the continuous supply of ink must be protected otherwise it will find its way onto anything it touches. This is commonly done by providing some kind of biased sleeve which extends beyond the indicia but which retracts automatically when the indicia is brought down onto the paper.

A more significant problem with stamps is the location of the stamp on the paper. Stamps commonly consist of a hand holder extending upwardly from the stamp and generally in the shape of the stamp. For instance, if the stamp is of rectangular form, the holder projects upwards in the shape of a rectangle for the user to hold. Consequently, there is a strong tendency for the stamp to go on unevenly because the user has no positive guide to ensure that the whole of the indicia is coming down simultaneously onto the paper. It is not uncommon to see inked indicia which are very strongly evident on the paper in part of the indicia and weak in other parts.

Yet another difficulty is the location. Because of the type of stamps available, they can not be placed on the paper and at the same time show where the indicia is going to be placed because the user's hand hides the stamp.

It is among the objects of the present invention to provide a simplified self inking stamp which can be positioned on the paper and applied with minimal possibility of misalignment of the stamp on the paper.

SUMMARY OF THE INVENTION

Accordingly, in one of its embodiments the invention provides a self inking stamp for impressing an image on paper. The stamp comprises a body having a base including portions lying in a plane for engagement with a flat piece of paper, and a marker having a self inking indicia. The marker is movable relative to the base generally at right angles to the aforementioned plane, and a coupling is provided attaching the marker to the base at a location spaced from the marker generally parallel to the plane. The coupling permits movement of the marker to a stored position inside the body and spaced from the plane, and an inking position with the marker is in engagement with the paper.

BRIEF DESCRIPTION OF THE DRAWINGS

This and other aspects of the invention will be more fully understood with reference to the following description and drawings in which.

DESCRIPTION OF THE PREFERRED EMBODIMENTS

Figure 1:
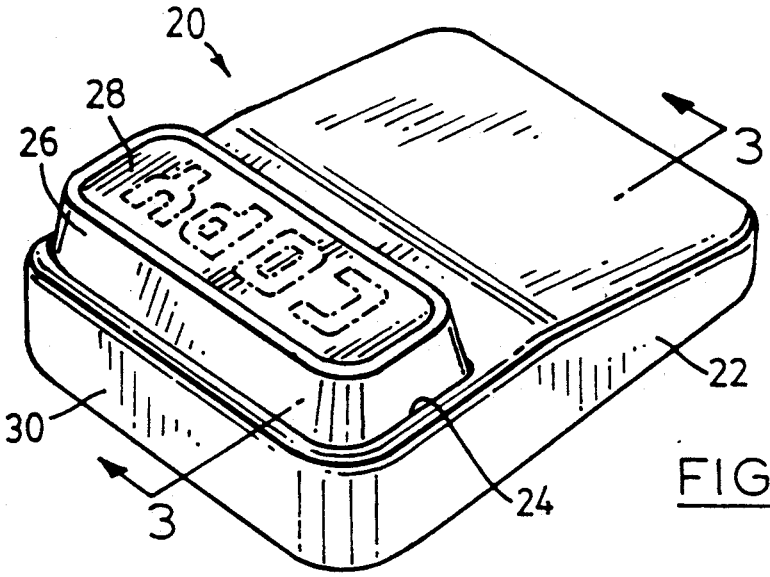
FIG. 1 is an isometric view of a first embodiment of a self inking stamp according to the invention and preferred where simplicity and economy are uppermost.

Reference is made first to FIG. 1 which illustrates a self inking stamp designated generally by the numeral 20 and showing in appearance the generally mouse-like shape of the structure (mouse being a term used in the computer art to describe structures of this shape). It can be seen that a body 22 defines an upwardly projecting opening 24 containing a pressure plate 26 on top of which is a label 28 showing exactly the indicia which is to be impressed onto paper by the stamp. The body 22 is closed upwardly and rounded and has a generally rectangular shape in plan view. The pressure plate 26 projects upwardly from the body and is located adjacent a shorter side 30 of the rectangular shape and so that the user can hold the device between thumb and forefinger with slight palm pressure adjacent the part of the body remote from the pressure plate. The user then uses fingers, once the stamp is located, to press the pressure plate and bring the marker (to be described) in contact with the paper. Consequently, it will be evident that the stamp can rest on the paper, can then be located and finally the user can press the pressure plate to apply the indicia on the paper.

Figure 2:
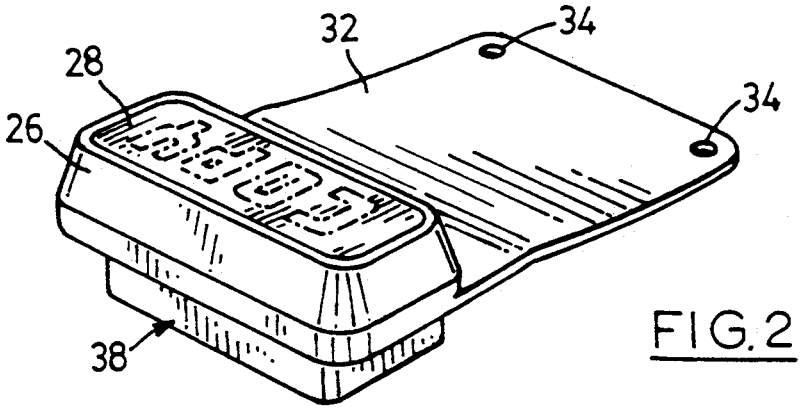
FIG. 2 is an isometric view of part of the stamp.
Figure 3:
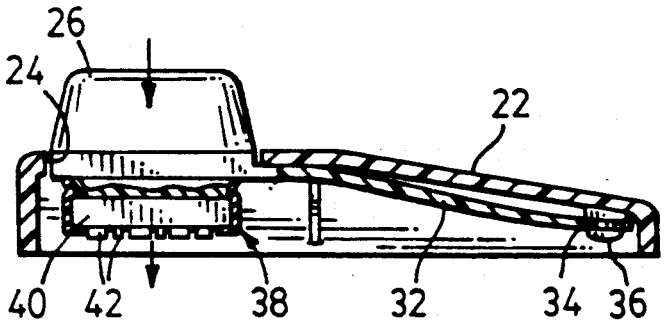
FIG. 3 is a sectional view on line 3—3 of FIG. 1.

Reference is next made to FIG. 2 which illustrates a part of the marker which can also be seen in the sectional FIG. 3. The pressure plate 26 is on one end of a coupling 32 which at its other end has a pair of attachment openings 34 for engagement on rivets or other features 36 seen in FIG. 3. The coupling 32 is flexible and on the underside, as drawn in FIG. 3, a marker 38 is provided of conventional form and including a pad 40 containing ink and porous indicia 42 through which ink will pass in use. The marker is attached by rivetting to suitable structure formed on the underside of the coupling 32 and can be removed and replaced as necessary to provide more ink. In many instances this will not be done because this is a very inexpensive structure and can be discarded in favour of a new one once the ink supply is used up, typically in as much as one year.

It will also be seen in FIG. 3 that the body 22, as mentioned, is closed but for the opening 24, but on its underside it is open and has peripheral structure lying in a plane for contacting the paper. This peripheral structure need not be continuous but it is preferably continuous for the sake of appearance.

In use, application on the pressure plate 26 in the direction of the arrows in FIG. 3 will result in deflecting the marker downwardly as the coupling 32 flexes about its attachment point or anchor to the body at fastener 36. This flexibility causes an angular motion of the marker and of course the coupling can be of many shapes and types to achieve this motion. In general, the coupling is attached to the body at an end of the body remote from the opening 24 and spaced from the marker generally in parallel to the plane containing the peripheral structure at the base of the body.

The marker is movable from the stored position shown in FIG. 3 downwardly (as drawn) into an inking position where the indicia is in contact with the paper. This movement is similar to that described in FIGS. 6 and 7 which show the movement in more detail.

Figure 4:
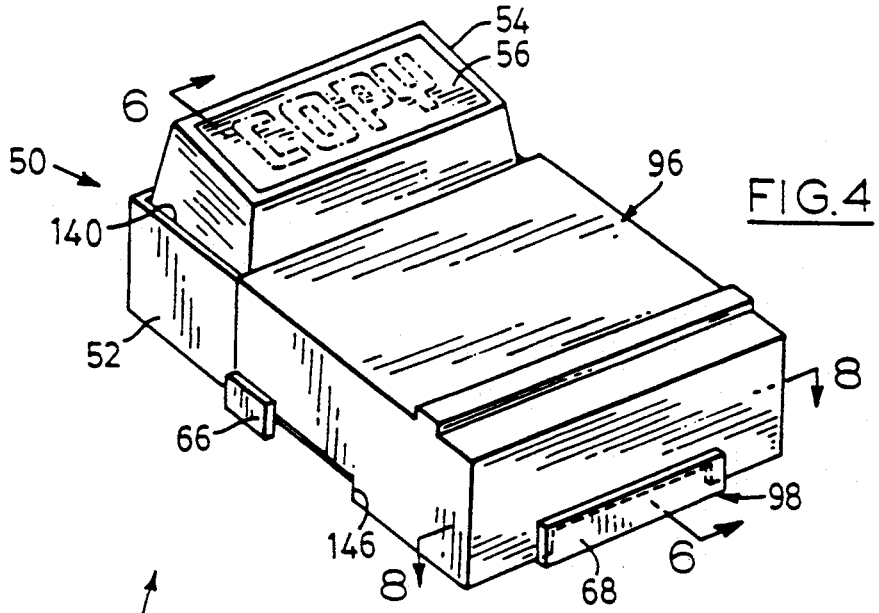
FIG. 4 is an isometric view of a second embodiment of the invention and preferred where a marker in the stamp is to be protected from accidental application.

Reference is next made to FIG. 4 which illustrates a second embodiment of the stamp indicated generally by the numeral 50. The stamp also includes a body 52, pressure plate 54, label 56, and (as seen in FIG. 6) indicia 58 on a marker 60 attached to a coupling 62 having an anchor 64 in the body.

Referring again to FIG. 4, an actuator 66 projects from both sides of the body (only one side being shown) for movement to open a cover which will be described later. A lock is provided internally so that the cover is retained in a withdrawn position to allow the marker to be used and to release the cover. A second actuator 68 is provided which can be moved to release the cover so that it moves under the influence of a biasing spring back into a closed position to protect the marker. This will become more apparent with reference to FIGS. 6, 7 and 8.

Figure 5:
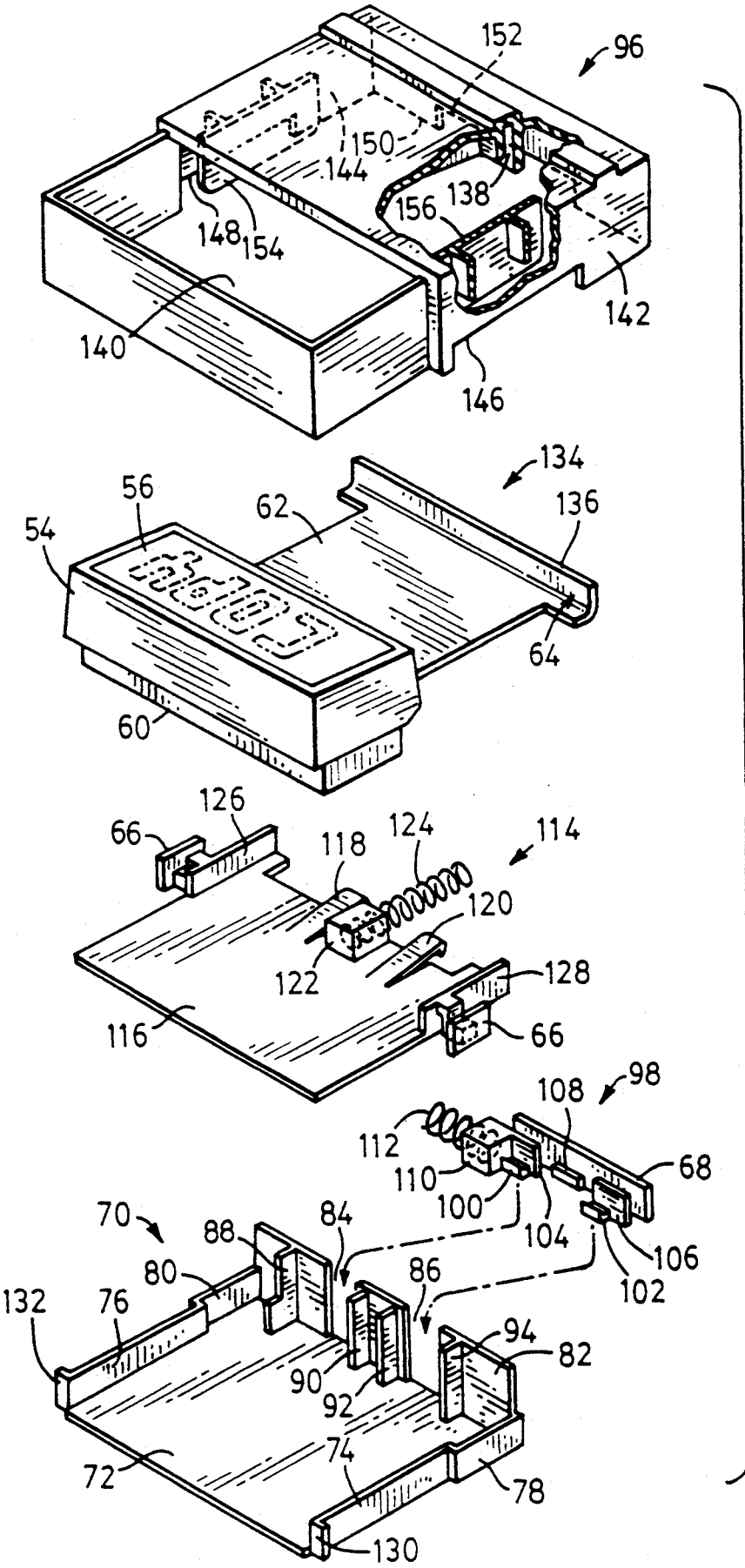
FIG. 5 is an exploded isometric view of the stamp of FIG. 4 and showing the parts used to make the marker.

FIG. 5 will now be described with reference to the parts as they are assembled. Starting at the bottom of FIG. 5, a base element 70 has a floor 72 and recessed side walls 74, 76 and further wall portions 78, 80. These portions extend to a back wall 82 which define a pair of full height slots 84, 86 and inwardly projecting ribs 88, 90, 92, and 94. The wall 82 is higher than the other walls for full engagement inside a top element 96 as will be described.

Figure 6:
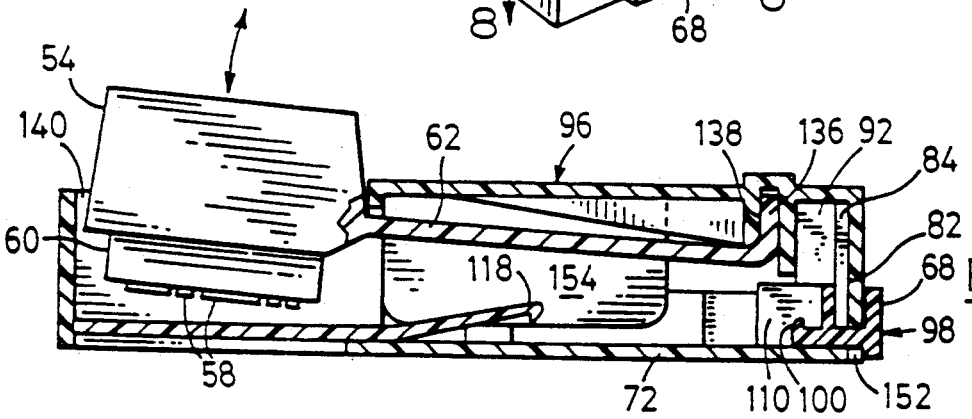
FIG. 6 (drawn adjacent FIG. 4) is a sectional view on line 6—6 of FIG. 4 and illustrating the stamp with the marker in a stored position and a cover protecting the marker in a closed position.
Figure 7:
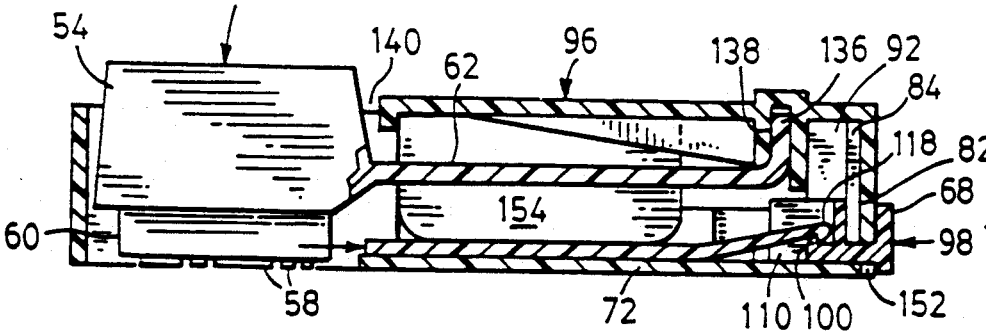
FIG. 7 is a view similar to FIG. 6 and showing the marker in an inking position with the cover is in a withdrawn position.

Returning to the foot of FIG. 5, a lock element 98 is made up of the second actuator 68 mentioned with reference to FIG. 4, and a pair of hooks 100, 102 attached to slider plates 104, 106 which are in turn attached by connecting pieces to the actuator 68 and spaced from the actuator for reasons which will be shown in FIGS. 6 and 7. A spacer 108 is also provided on the actuator 68 and has a thickness less than the spacing between the slider plates 104, 106 and the actuator 68.

The slider plate 104 and hook 100 are integrally connected to a hollow box 110 which contains a compression spring 112 to bias the lock element to the right as drawn. The element 98 is engaged in the base element 70 by dropping it into the slots 84, 86 with the connections for the slider plates 104, 106 resting in the slots. The spring is engaged in the rib 88 so that the structure is biased away from the rib 88 and into engagement with the ribs 90, 94 which serve the purpose of location. When the actuator 68 is pushed against the spring, it carries the hooks along the floor 72 until contact is made with the rib 92 which acts as a stop in the other direction.

With the lock element engaged in the base element, the cover assembly shown generally by the numeral 114 is dropped onto the floor 72. This cover assembly includes a cover 116 having a pair of integral hooked arms 118, 120 normally aligned with the hooks 100, 102 of the lock element 98. Between the hooked arms 118, 120 is a hollow box 122 containing the second compression spring 124. To the sides of the hooked arms lies a pair of respective upright walls 126, 128 from which a suspended respective first actuators 66 on connections designed to allow the cover 116 to slide on the floor 72 with the actuators outside the recessed walls 74, 76 and spaced sufficiently to be also outside the top element as will be described.

The cover assembly 114 is placed inside the base element 70 resting on the floor 72 with the actuators 66 outside and respective end lips 130, 132 on the recessed walls 74, 76 holding the cover 116 from being dislodged by the compression spring 124 which is in engagement with the wall 82 of the base element 70 and between the ribs 90, 92 which serve to locate the spring. It will be evident by use of the actuators 66, the cover assembly 114 can be slid on the floor 72 until the hooked arms 118, 120 engage the hooks 100, 102 as will be described with reference to FIG. 7.

A coupling assembly 134 includes anchor 64 and coupling 62, and is attached to the marker 60 with the indicia 58. The pressure plate 54 is also attached and carries the label 56. The anchor 64 consists of a upstanding rib which fits in a channel 138, formed in the top element 96 and seen in FIGS. 5 and 6.

The coupling 62 is flexible for movement about the anchor as will be described.

The coupling assembly 134 is pushed upwardly (as drawn in FIG. 5) into the top element 96 to engage a rib 136 in the channel 138 and to move the pressure plate 54 through an upwardly projecting opening 140 in the element 96. With these products assembled, the sub-assembly so formed can then be engaged in the other sub-assembly containing the remaining parts by dropping the top element downwardly on to and about the base element 70 marking sure that side walls 142, 144 are positioned with the actuator 66 outside the walls and available for sliding in bottom recesses 146, 148 formed in these walls. Similarily, a further wall 150 engages such that the actuator 68 is on the outside and movement is possible because the wall has a recess 152.

The top element 96 also includes a pair of side guide structures 154, 156 to better locate the coupling 62 which is proportioned to fit between these elements.

The use of the stamp will be described with reference to FIG. 6 to 8. As seen in FIG. 6, cover assembly 114 has the cover 116 located in a closed position containing the indicia 58 so that accidental inking cannot occur (the springs are not shown for the sake of clarity). By moving the actuators 66 shown in FIG. 4 along the respective recesses 146, (FIG. 5), the assembly 114 is moved towards the lock element 98 until the hook on arm 118 (and of course 120) meet the respective hooks 100 and 102 where they snap into place to retain the assembly 114 against energy stored in the spring 124 (FIG. 5). The stamp can now be used. The cover is in a withdrawn position and by applying manual pressure to the pressure plate 54, the coupling 62 is stressed and deflected into a position shown in FIG. 7 where the indicia is brought into contact with paper (not shown) and so that the marker effects making an inked copy on the paper corresponding to the label 56 shown in FIG. 4. The marker is then in the inking position and, when manual pressure is removed, energy in the coupling 62 will cause the marker to return to the stored position shown in FIG. 6. If it is intended that the cover 116 return to protect the marker, this is done by sliding the actuator 68 against spring 112, (FIG. 5) so that the hooks 100, 102 come out of alignment with the hooked arms 118, 120 thereby allowing the spring 124 to return the cover assembly 114 to the FIG. 6 position.

Figure 8:
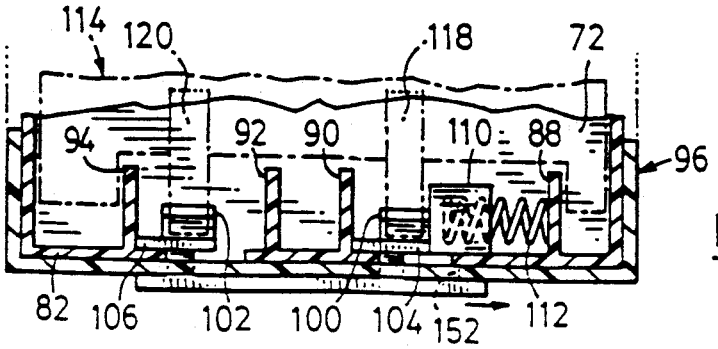
FIG. 8 is a sectional view on line 8—8 of FIG. 4 and illustrating a lock used to releasably retain the cover in the withdrawn position.

The assembly of the lock element 98 can be seen in FIG. 8 where it will be evident that the sliding action will release the hooks from the hooked arms.

The invention has been described with reference to two embodiments, and as mentioned, the first embodiment is considered to be an inexpensive device having the advantages of the inventive concept and the second embodiment is a more sophisticated device which has further advantages. These structures and others are within the scope of the invention as claimed.

We claim:

1. A self-inking stamp comprising:

a hollow body which is generally rectangular in plan view and has a front end, a rear end and two opposite sides, said body also having a rectangular upper surface with a rectangular upper opening adjacent said front end and extending for substantially the whole width of the body from one side to the other, a lower rectangular opening below the upper opening, and a lower surface lying in a plane for engagement with a flat article to be stamped, a rectangular marker in the body positioned over the lower rectangular opening for movement therethrough and having a manually-engageable rectangular pressure plate substantially the same size as the upper rectangular upper opening and projecting upwardly through the paper rectangular opening, said rectangular marker having self-inking indicia defining an image to be impressed on an article, a resiliently flexible rectangular plate-like coupling member in the rectangular body and extending from the rectangular marker beneath said upper surface of the rectangular body to a position adjacent the rear end of the body, and anchor means securing the coupling member to the body adjacent the rear end of the body, whereby application of finger pressure to the rectangular pressure plate causes the rectangular marker to move through the lower rectangular opening to an inking position and apply an inked image to an article on which the stamp is placed, said resiliently flexible rectangular plate-like coupling member flexing to permit such movement of the marker and returning the marker to its original position when finger pressure is removed from the pressure plate.

2. A self-inking stamp according to claim 1 wherein the anchor means secures the coupling member to the interior of the upper surface of the hollow body.

3. A self-inking stamp according to claim 2 including a slidable cover mounted on the body for movement between a closed position covering the lower opening to protect the marker and an open position wherein the cover is clear of the lower opening to permit the marker to move therethrough.

4. A self-inking stamp according to claim 3 including bias means for urging the cover into the closed position.

5. A self inking stamp according to claim 4 including releasable means for retaining the cover in the open position.

* * * * *